United States Patent [19]

Wronski et al.

[11] 3,987,327

[45] Oct. 19, 1976

[54] LOW DARK CURRENT PHOTOCONDUCTIVE DEVICE

[75] Inventors: Christopher Roman Wronski, Princeton; Appleton Danforth Cope, Hightstown; Benjamin Abeles, Princeton, all of N.J.

[73] Assignee: RCA Corporation, New York, N.Y.

[22] Filed: Jan. 2, 1975

[21] Appl. No.: 537,847

Related U.S. Application Data

[63] Continuation-in-part of Ser. No. 423,443, Dec. 10, 1973, abandoned.

[52] U.S. Cl. ..... 313/386; 313/94

[51] Int. Cl.[2] ..... H01J 29/45; H01J 31/38

[58] Field of Search ..... 313/385, 386, 384, 388

[56] References Cited

UNITED STATES PATENTS

| | | | |
|---|---|---|---|
| 2,927,234 | 3/1960 | Kazan | 313/384 |
| 3,136,909 | 6/1964 | Cope | 313/390 |
| 3,419,746 | 12/1968 | Crowell et al. | 313/392 |
| 3,805,128 | 4/1974 | Scholl et al. | 357/15 |

*Primary Examiner*—Robert Segal

*Attorney, Agent, or Firm*—Glenn H. Bruestle; Robert J. Boivin

[57] ABSTRACT

A photoconductive body of antimony trisulfide is coated on one surface with a layer of an insulating material having particles of a conductive metal dispersed throughout. When used as a target for a vidicon type camera tube, the metal particle-containing insulating layer lowers the dark current of the tube without affecting the photocurrent or spectral response.

15 Claims, 5 Drawing Figures

LOW DARK CURRENT PHOTOCONDUCTIVE DEVICE

This application is a continuation-in-part of U.S. application Ser. No. 423,443, filed on Dec. 10, 1973 now abandoned.

BACKGROUND OF THE INVENTION

This invention relates to antimony trisulfide photoconductive devices and more particularly to photoconductive targets for vidicon-type camera tubes.

Antimony trisulfide is a through conductive bulk resistance type photoconductive material which has long been used in targets for vidicon-type camera tubes. The dark current in such a target constitutes the conduction or leakage of electrons from an electron beam scanned surface of the target through an antimony trisulfide photoconductive body to a signal plate, in the dark or in the absence of illumination striking the target (i.e. the non-illuminated signal current). This leakage or non-illuminated signal current is considered to be objectionably high (on the order of about 20 nanoamperes per $cm^2$ of target area at target voltages of from 30–40 volts) and is the result of the characteristic bulk resistivity of antimony trisulfide of about $10^{11}$–$10^{12}$ ohms-cm.

In order to retain a desired contrast level between target areas which are illuminated or exposed to radiant energy and those which are not, it is desirable to have a signal current contrast ratio significantly greater than that ordinarily associated with prior art antimony trisulfide bodies. The signal current contrast ratio consists of the output signal current associated with an illuminated target minus the non-illuminated signal current divided by the non-illuminated signal current. It is therefore particularly desirable to provide a substantial increase in the effective through resistance of the target which exceeds the characteristic resistance of the antimony trisulfide body alone, without also adversely affecting the quantum efficiency and sensitivity of the target in order to achieve the desired improvement in the contrast ratio.

One technique which has been used to reduce the dark current of a photoconductive target employing antimony trisulfide is to coat the photoconductive body with a homogeneous insulating or dielectric layer as disclosed in U.S. Pat. No. 3,136,909; however, such a target structure is not through-conducting and only provides a transitory capacitance type readout which requires complicated erase and discharge techniques for sensing and storing successive images. Such target structures permit only a single transitory readout for each stored image.

Other photoconductive bodies employed as targets for vidicon-type camera tubes include semiconductor photoconductive materials which, unlike antimony trisulfide, are known in the prior art to be capable of fabrication in contact with other materials of opposite electrical conductivity to form a blocking contact having characteristics similar to p-n junctions at the interface between the disimilar materials. Prior art attempts to fabricate similar blocking contacts with photoconductive targets including antimony trisulfide bodies have proven ineffective generally and have resulted in inferior signal current contrast ratios in comparison with antimony trisulfide targets without such additional structure. Moreover, in such structures, a mosaic arrangement of such blocking contacts, or p-n junctions, must be fabricated because of the low resistance of suitable semiconductor materials. Such "structured targets" require more complicated and considerably more costly manufacturing techniques as compared with those normally associated with antimony trisulfide targets.

SUMMARY OF THE INVENTION

A target for a photoconductive device includes a photoconductive body of antimony trisulfide and an electrically insulating layer on the surface of the body. The electrically insulating layer has conductive particles dispersed throughout.

DESCRIPTION OF THE PREFERRED EMBODIMENT

Figure 1:
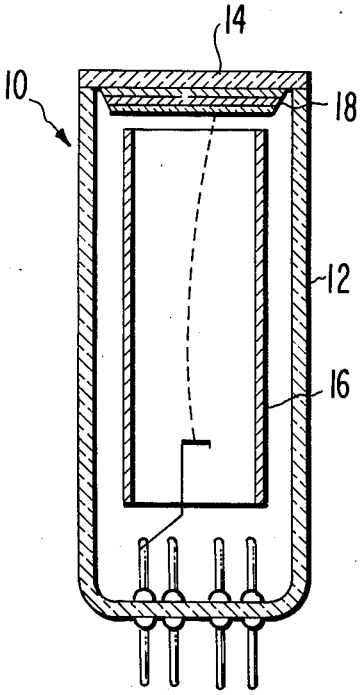
FIG. 1 is a sectional view of a vidicon type camera tube which includes the target of the present invention.

Referring initially to FIG. 1, a vidicon-type camera tube is generally designated as 10. The camera tube 10 is of conventional construction and includes an elongated envelope 12 having a transparent faceplate 14 at one end thereof. An electron-beam forming and scanning means 16 is within the envelope 12. The electron-beam forming and scanning means 16 may be of any well-known construction. A target 18 embodying the present invention is within the envelope 12 and is attached to the inside surface of the faceplate 14. Scanning of the electron beam may also be achieved by magnetic coils (not shown) situated outside the envelope 12.

Figure 2:
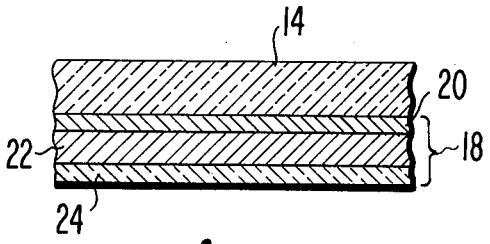
FIG. 2 is a sectional view of a portion of the target of the present invention.

As shown in FIG. 2, the target 18 comprises a layer 20 of a transparent conductive material, such as tin oxide, disposed on the inside surface of the faceplate 14. A photoconductive body 22, of antimony trisulfide, is disposed on the conductive layer 20. The antimony trisulfide photoconductive body 22 may be of any well-known form used in vidicon-type camera tubes, such as a solid body, porous body, or combination solid and porous body. On the available surface of the photoconductive body 22 is disposed a layer 24 of an electrically insulating material having fine particles of conductive material (not shown) dispersed throughout. The insulating material layer 24 may be of any inorganic insulating material, such as silicon oxide, aluminum oxide, silicon nitride, boron nitride, etc.; and the conductive particles in the insulating material layer 24 may be of any conductive metal, such as gold, silver, copper, tungsten, aluminum, etc. Generally, the conductive particles should constitute from about 7 to about 13% by volume of the conductive-particle-containing insulating layer 24. A particulate concentration is selected for the layer 24 which permits through-conduction of electrons from the electron beam scanned surface to the conductive layer 20. The conductive particles are preferably about 20A in diameter and also preferably constitute about 10% by volume of the conductive-particle-containing insulating layer 24. The layer 24 preferably has a thickness of about 500 to 5000 angstroms. The target 18 can be made by first applying the transparent conductive layer 20 onto the inside surface of the faceplate 14. This can be accomplished by any well-known coating technique, such as by vacuum evaporation or, in the case of tin oxide, spraying the tin oxide and condensing it on the faceplate. The antimony trisulfide photoconductive body 22 can then be coated on the conductive layer 20 by any well-known technique, such as by vacuum evaporation. The insulating layer 24 is then applied to the photoconductor layer 22, such as by simultaneously evaporating the insulating and conductive materials in a vacuum or by sputtering and codepositing the two materials on the photoconductive body 22.

Figure 3:
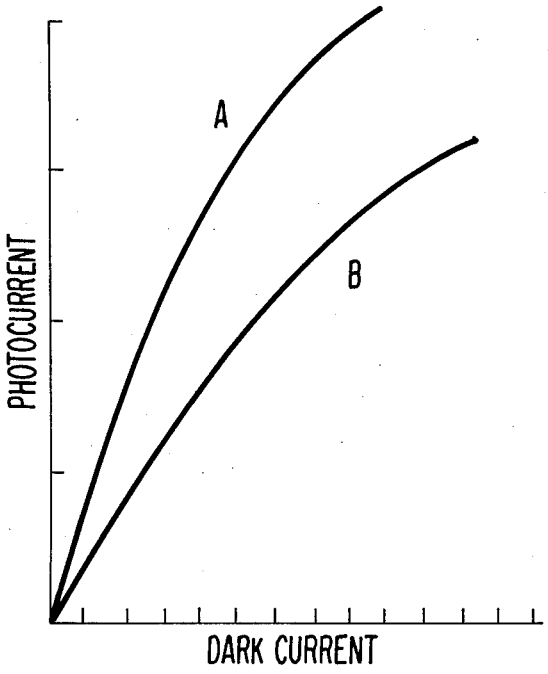
FIG. 3 is a graph comparing the photocurrents as a function of dark current for the target of the present invention and a similar target of the prior art.

The vidicon-type camera tube 10 having the target 18 has a lower dark current than that of a vidicon-type camera tube having an antimony trisulfide photoconductive target without the insulating layer 24. However, the photocurrent and spectral response of the tube 10, as functions of target voltage, are relatively unaffected by the addition of the insulating layer 24. This is shown in FIG. 3, which displays the photocurrents, as functions of dark current, experimentally obtained at a fixed light intensity incident on two vidicon-type camera tubes, one having the target 18 (curve A) and the other having a similar target without the insulating layer 24 (curve B). For any given photocurrent, the target 18 is shown to have a dark current approximately one-half that of the similar target without the insulating layer 24.

Figure 4:
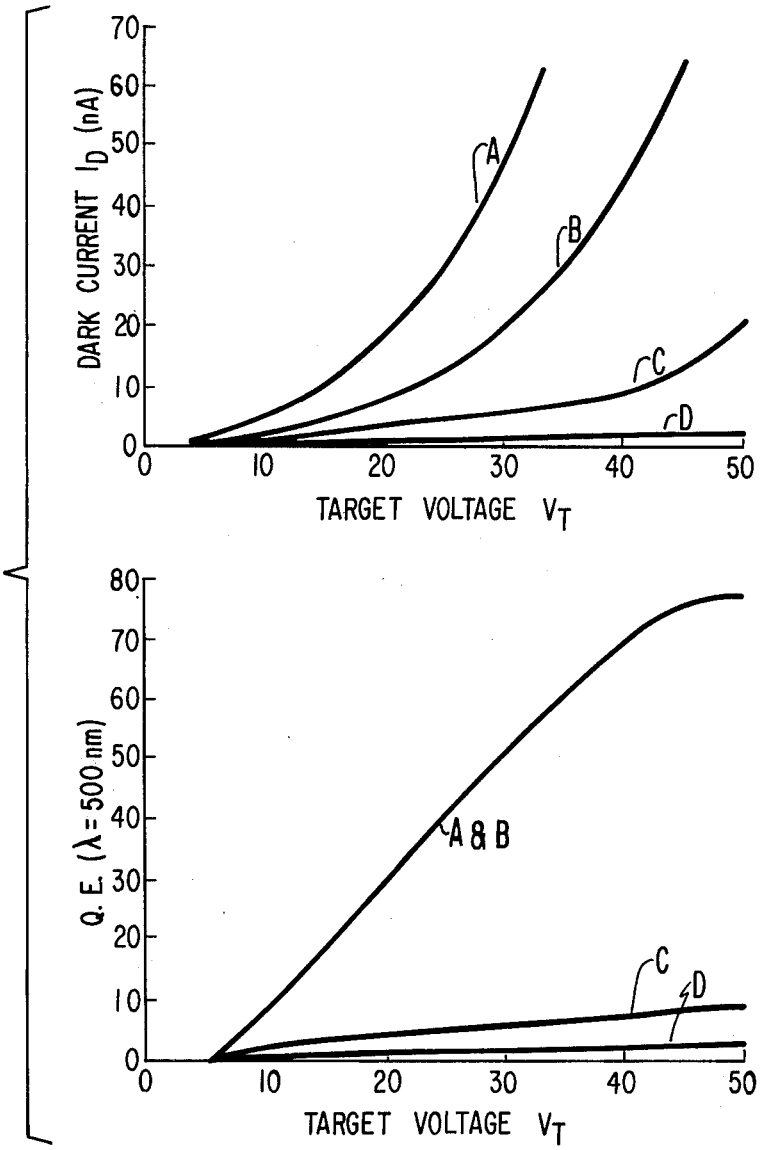
FIG. 4 is a graph comparing typical operational data for targets made in accordance with the invention with comparable operational data for various prior art antimony trisulfide targets.

The performance of vidicon type camera tubes similar to that shown in FIG. 1, may be graphically compared with other similar or modified prior art vidicon structures. Referring to FIG. 4, there is shown a graphical comparison of typical operational data relating the dark current and quantum efficiency characteristics of various types of antimony trisulfide targets which have been employed in prior art vidicon-type camera tubes with the novel target herein described. Curve A depicts operational data for prior art antimony trisulfide targets, whereas Curve B depicts the corresponding operational data for similar targets made in accordance with the invention and additionally including the layer 24. Curves C and D depict the corresponding operational data for prior art antimony trisulfide targets having a layer similar to layer 24, however consisting of a material which is a p-type semi-insulator (e.g. SeTeAs-alloy), and an insulator (e.g. $As_2S_3$), respectively.

Referring to Curve B of FIG. 4, it may be seen that, at any given target voltage $V_t$ ordinarily employed, the target 18 operationally outperforms conventional antimony trisulfide targets (Curve A), by providing a significant reduction in dark current without affecting the characteristic quantum efficiency of antimony trisulfide.

Figure 5:
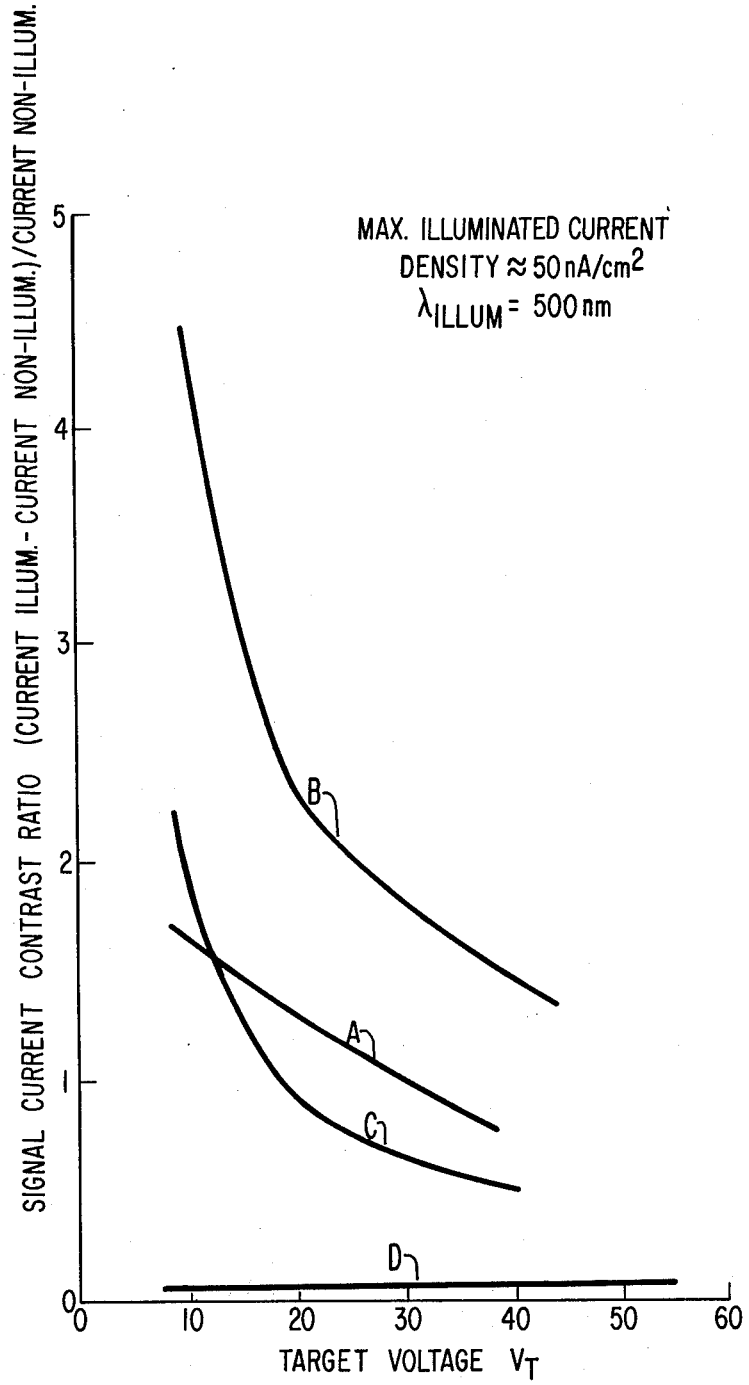
FIG. 5 is a graph comparing the signal current contrast ratios for alternative targets having the characteristics depicted in FIG. 4.

In the novel target 18, a blocking contact, or heterojunction, is formed at the interface between various ones of the conductive particles of the insulating layer 24 and the surface portions of the antimony trisulfide body 22 in contact with those particles. Each of the heterojunctions formed at the interface between the body 22 and layer 24 functions, within an operative vidicon, in a manner analogous to a reverse-bias p-n junction, thereby significantly increasing the effective "through" resistance of the target to conduction of electrons between the electron beam surface and the signal plate or conducting layer 20 of the target 18. Since the conductive particles abutting the body 20 each form a separate substantially isolated heterojunction or blocking contact with the body 22, excellent lateral resolution is maintained. Most importantly, however, the signal current contrast ratio between target areas which are illuminated and those which are not, is significantly improved. Referring to FIG. 5, the signal current contrast ratios of the novel target (Curve B) is compared with the alternative targets depicted in FIG. 4 (Curves A, C, D) at a wavelength of illumination of 500 nm. and a maximum current density of 50na./cm.$^2$. As seen in FIG. 5, a significant improvement in the contrast ratios is achieved for the novel target in excess of 50 percent of the characteristic contrast ratios normally associated with targets employing solely an antimony trisulfide body (such as Curve A), or other similar targets which are coated with a semi-insulator (Curve C) or insulator materials (Curve D).

The significant improvement in the signal current contrast ratios was totally unexpected. Prior attempts at fabricating similar heterojunction type antimony trisulfide targets have, for numerous reasons, been unsuccessful. More specifically, various attempts have been made to employ, in combination with antimony trisulfide photoconductive bodies, p-type semi-insulator (e.g. SeTeAs alloys shown as Curve C in FIGS. 4 and 5) and insulator (e.g. $As_2S_3$ shown as Curve D in FIGS. 4 and 5) materials without success. As seen in FIGS. 4 and 5, such prior art approaches while effective for reducing dark current, have adversely decreased quantum efficiency as a function of target operating voltage $V_t$, and have not generally improved the signal current contrast ratios over that normally associated with antimony trisulfide bodies without such additional material layers (i.e. the "characteristic signal current contrast ratios"). Such structures (Curve C and D) either are unable to achieve a satisfactory quantum efficiency at any normally employed target voltage $V_t$ or else require exceedingly high values of operating voltages to achieve generally inferior levels of quantum efficiency.

We claim:

1. A photoconductive device comprising:

a. a photoconductive body of antimony trisulfide including opposed major surfaces;

b. a through-conducting layer on one of said major surfaces of said antimony trisulfide body; said layer comprising an insulating material having metal particles dispersed throughout and including a plurality of said metal particles in contact with said body to form therewith heterojunctions to significantly increase the signal current contrast ratios associated with said device in contrast with those ratios associated with similar devices not including said layer.

2. A photoconductive device in accordance with claim 1 wherein said metal particles constitute from about 7 to about 13 percent by volume of the material of said layer.

3. A photoconductive device in accordance with claim 2 in which said insulating material consists essentially of an inorganic material.

4. A photoconductive device in accordance with claim 3 in which said insulating material is selected from the group consisting of silicon oxide, aluminum oxide, silicon nitride, and boron nitride.

5. A photoconductive device in accordance with claim 3 including a layer of transparent conductive material on said major surface of said body opposite to that having said layer thereon.

6. A photoconductive device in accordance with claim 5 wherein said metal particles constitute about 10% by volume of the material of said layer.

7. A camera tube comprising:

a. an envelope including a transparent faceplate portion;

b. an electron beam forming and scanning means within said envelope for scanning an electron beam along a path;

c. a target within said envelope on said faceplate portion; said target including a surface in the path of said electron beam, said target including in a direction of thickness away from said faceplate portion toward said surface of said target in the path of said electron beam:

1. a layer of transparent conductive material on said faceplate portion;

2. a body of antimony trisulfide on said layer of transparent conductive material;

3. a through-conducting layer on said body comprising an insulator material having conductive particles of metal dispersed throughout; said metal particles comprising from about 7 to about 13% by volume of said through-conducting layer and including a plurality of said conductive particles in contact with said body to form therewith a plurality of heterojunctions.

8. The camera tube of claim 7 wherein said insulator comprises an inorganic material.

9. The camera tube of claim 8 wherein said through-conducting layer has an approximate thickness of from 500 to 5000 Angstroms.

10. The camera tube of claim 9 wherein said insulating material is selected from the group consisting of silicon oxide, aluminum oxide, silicon nitride and boron nitride.

11. The camera tube of claim 10 wherein said particles of metal have an approximate diameter of less than 20 Angstroms.

12. A photoconductive device including an antimony trisulfide body, the body having associated therewith characteristic signal current contrast ratios, the improvement comprising:

a through-conducting layer on a surface of said body consisting of an insulating material with conductive particles dispersed throughout for significantly improving the signal current contrast ratios associated with said device over said characteristic ratios.

13. The photoconductive device of claim 12 wherein said particles are metal particles.

14. The photoconductive device of claim 13, wherein said metal particles comprise from about 7 to about 13% by volume of the material of said layer.

15. The photoconductive device of claim 14, wherein said metal particles comprise about 10% by volume of the material of said layer.

* * * * *